US005918866A

United States Patent [19]

Klimach

[11] Patent Number: 5,918,866

[45] Date of Patent: Jul. 6, 1999

[54] STRAP CLAMPING DEVICE

[75] Inventor: Horst Klimach, Ilsfeld-Auenstein, Germany

[73] Assignee: Bessey & Sohn GmbH & Co., Bietighein-Bissingen, Germany

[21] Appl. No.: 08/927,999

[22] Filed: Sep. 11, 1997

Related U.S. Application Data

[63] Continuation of application No. 08/610,709, Mar. 4, 1996, abandoned.

[30] Foreign Application Priority Data

Mar. 4, 1995 [DE] Germany ..... 195 07 699

[51] Int. Cl.[6] ..... B25B 1/20

[52] U.S. Cl. ..... 269/3; 269/42; 269/108; 269/109; 269/130; 269/131

[58] Field of Search ..... 269/3, 108, 109, 269/130, 131, 132, 287, 41, 42; 81/3.43, 64

[56] References Cited

U.S. PATENT DOCUMENTS

| | | | |
|---|---|---|---|
| 442,934 | 12/1890 | Ackerman | 269/131 |
| 633,657 | 9/1899 | Muller | 269/108 |
| 720,816 | 2/1903 | Karl | 269/131 |
| 891,121 | 6/1908 | Wichers | 269/108 |
| 1,053,556 | 2/1913 | Bergstrom | 269/108 |
| 1,770,763 | 7/1930 | Wolfstyn | 269/131 |
| 2,696,232 | 12/1954 | Johnson | 269/108 |
| 3,584,860 | 6/1971 | Ervin | 269/131 |
| 4,171,799 | 10/1979 | Elko | 269/42 |
| 4,560,153 | 12/1985 | Han | 269/42 |
| 5,161,789 | 11/1992 | Rogers | 269/109 |

FOREIGN PATENT DOCUMENTS

| | | | |
|---|---|---|---|
| O 346 721 | 12/1989 | European Pat. Off. . | |
| 717 381 | 1/1932 | France . | |
| 181 133 | 2/1907 | Germany . | |
| 85 11 115 | 10/1985 | Germany . | |
| 152655 | 5/1932 | Switzerland | 269/131 |
| 4118 | of 1873 | United Kingdom | 269/108 |
| 1 006 056 | 9/1965 | United Kingdom . | |
| WO 82/03041 | 9/1982 | WIPO . | |

*Primary Examiner*—Robert C. Watson
*Attorney, Agent, or Firm*—Barry R. Lipsitz; Ralph F. Hoppin

[57] ABSTRACT

To improve a strap clamping device comprising a clamping strap forming an outer loop to wrap around one or several workpieces, and a tightening device for tightening the outer loop to clamp the workpiece or workpieces, such that it is operable in as convenient a way as possible, it is proposed that the tightening device comprise a base element supported on the loop with a guide opening through which the loop is guided, that the tightening device include a pull element, that the pull element and the base element be moveable relative to each other by means of an adjusting device, and that the loop run between the base element and the pull element and engage the pull element such that upon relative movement of the base element and the pull element, the outer loop is tightenable under the effect of a double pulley.

33 Claims, 8 Drawing Sheets

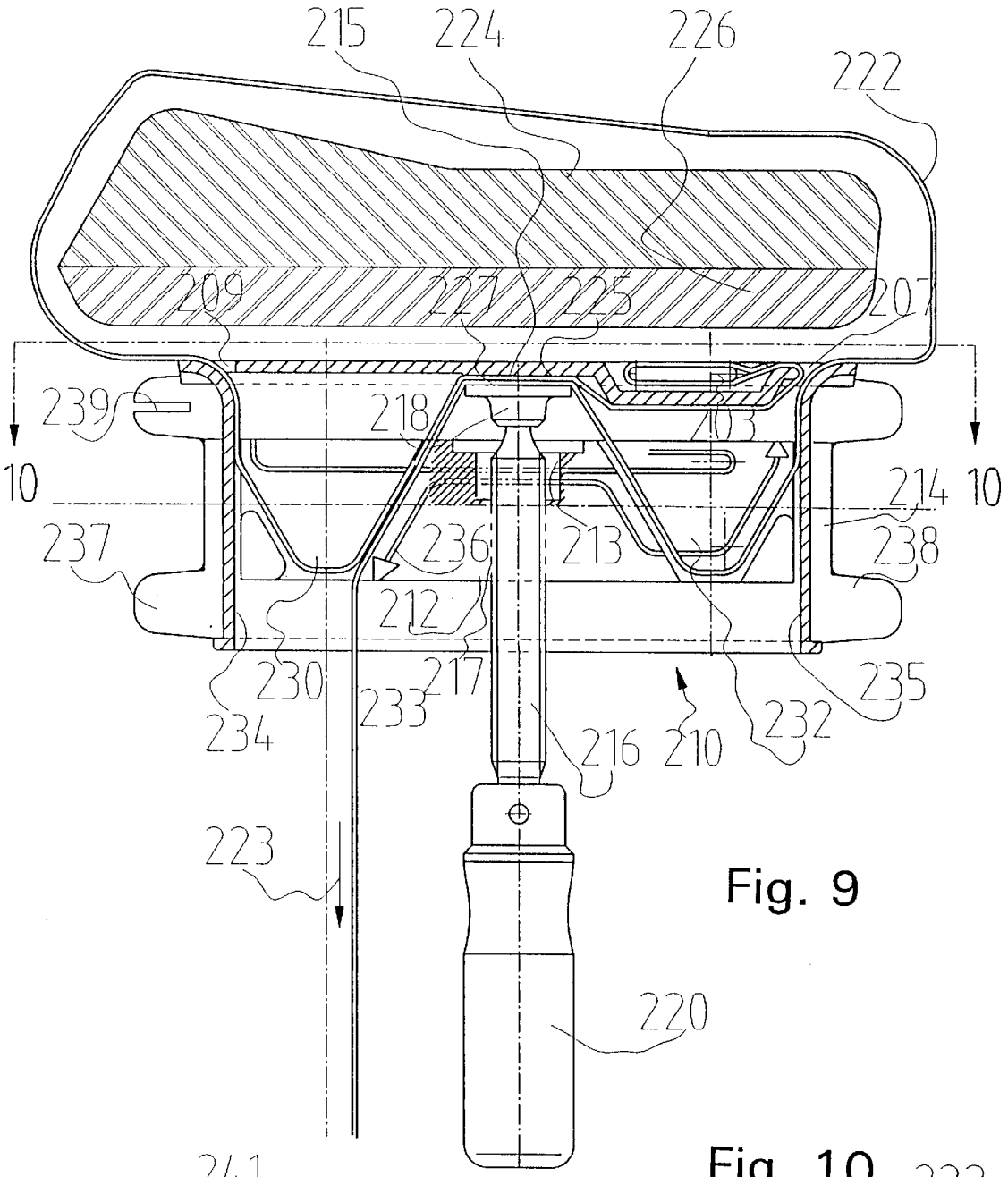
Fig. 9
Fig. 10
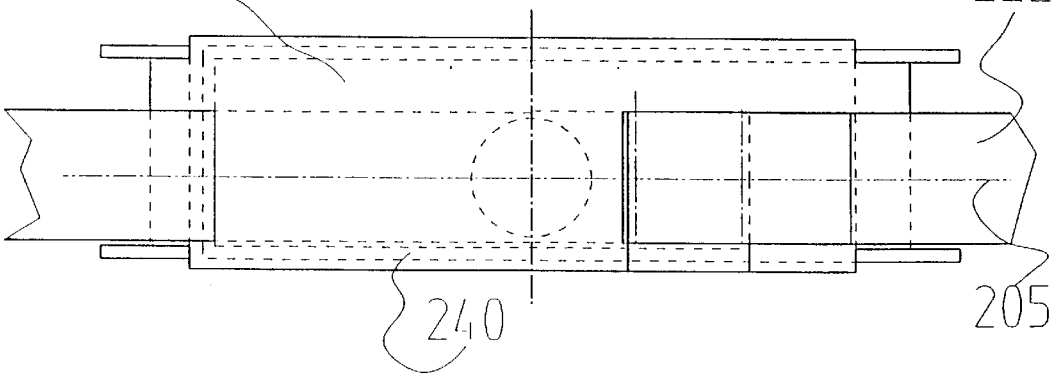

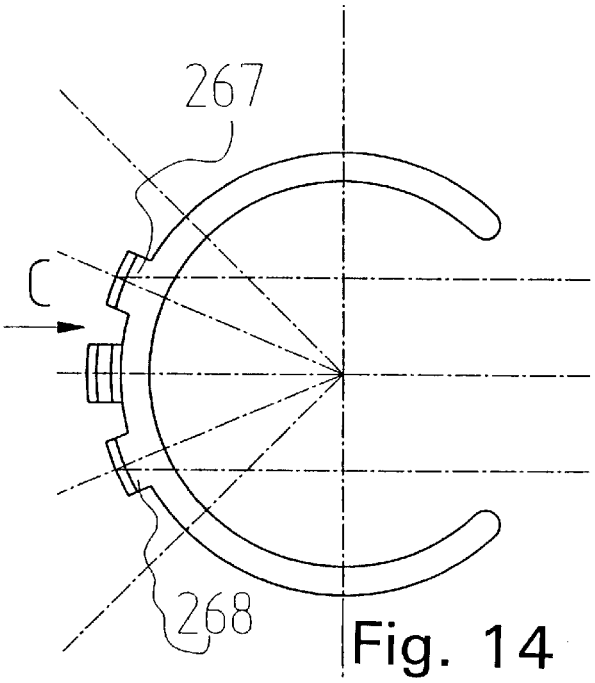
Fig. 14
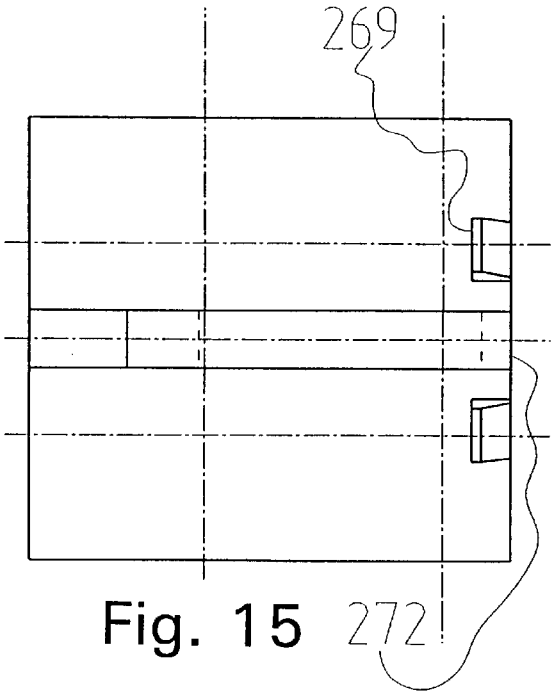
Fig. 15
Fig. 16
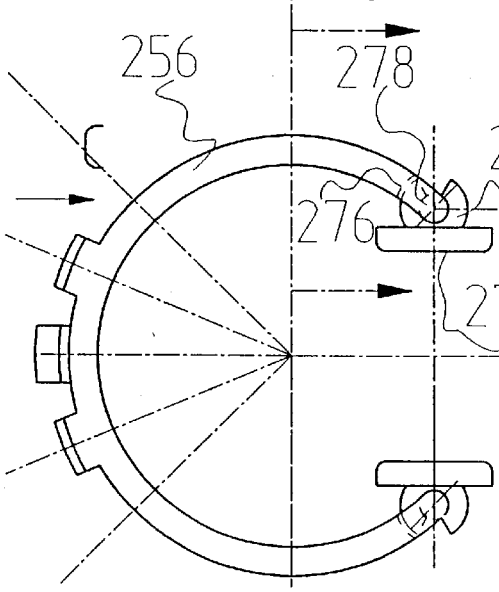
Fig. 17
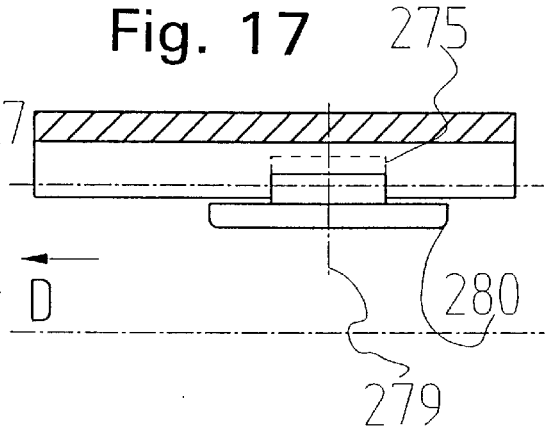

STRAP CLAMPING DEVICE

This application is a continuation of commonly assigned, U.S. patent application Ser. No. 08/610,709 filed Mar. 4, 1996 now abandoned.

BACKGROUND OF THE INVENTION

The invention relates to a strap clamping device comprising a clamping strap forming an outer loop to wrap around one or several workpieces, and a tightening device for tightening the outer loop to clamp the workpiece or workpieces.

Such strap clamping devices serve to clamp a clamping strap extending around workpieces of very different shapes.

Such strap clamping devices are particularly well suited for holding together irregularly shaped parts or parts with interrupted circumferential surfaces such as, for example, chair backs or chair legs. Irregularly shaped parts also include columns, kidney-shaped furniture or oval workpieces.

Ordinary frames of square, hexagonal or octagonal shape can also be clamped with such strap clamping devices.

With such strap clamping devices it is particularly advantageous, for better and gentler clamping of workpieces with corners, to additionally use corner elements—also referred to as clamping corners—in the region of the corners.

Strap clamping devices are known in a wide range of structural designs.

For example, strap clamping devices are known in which a lashing strap with strap ratchet is used. Other embodiments of strap clamping devices use a spindle with spindle nut for actuating the strap guide. However, in these solutions it is necessary to fix the two strap sides or strap ends firmly, and the holding of the strap during the clamping depends on how good the fixing is.

When textile straps are used as clamping straps, their large stretching is disadvantageous and is particularly noticeable when the loop has large dimensions. For this reason, metal straps are also used with strap clamping devices, but these have the disadvantage that they are awkward to handle and snap open.

In a strap clamping device design known from EP-0 302 806, the tightening device is designed so as to pull at both ends of the outer loop, and the textile strap used as clamping strap is wound onto two rolls during the clamping. However, this solution has the disadvantage that owing to the different circumferential dimensions during the winding of the clamping strap onto the rolls, uneven pulling occurs at the two sides of the outer loop.

Furthermore, the operating of the tightening device via a single turning knob which has different functions in several positions is disadvantageous. One position is for pulling out the clamping strap freely, another for winding up the clamping strap quickly, and a third position for clamping the clamping strap in narrow detent positions.

The object underlying the invention is, therefore, to so improve a strap clamping device of the generic kind that it is operable as conveniently as possible.

SUMMARY OF THE INVENTION

This object is accomplished in accordance with the invention with a strap clamping device of the kind described at the outset in that the tightening device comprises a base element supported on the loop with a guide opening through which the loop is guided, in that the tightening device includes a pull element, in that the pull element and the base element are moveable relative to each other by means of an adjusting device, and in that the loop runs between the base element and the pull element and engages the pull element such that upon relative movement of the base element and the pull element, the outer loop is tightenable under the effect of a double pulley.

The advantage of the inventive solution is to be seen in that even a simple relative movement of pull element and base element results in a reduction in size of the outer loop which is as rapid and efficient as possible and hence in clamping by the double pulley effect upon relative movement of base element and pull element.

In addition, the inventive strap clamping device is simple to operate as only a relative movement between base element and pull element has to be brought about by means of the adjusting device to tighten the outer loop.

The double pulley effect is achievable with the loop being guided in many different ways between base element and pull element.

In an embodiment which is particularly advantageous from the point of view of simplicity, the loop rests at a first location on the base element and at least at two further locations on the pull element in engagement therewith.

Herein it is particularly expedient for the loop to form two loop sections whose turns form the two further locations at which the loop rests on the pull element in engagement therewith. The double pulley effect can be brought about in a simple way with these two loop sections, with an end of the loop preferably lying at one end of each loop section and the clamping strap continuing into the outer loop at the other end of the loop section.

The way in which the loop is placed on the workpieces before the clamping strap is clamped has still to be explained in greater detail. It is particularly advantageous for the size of the loop to be variable so as to enable it to be placed on very different workpieces.

This can, for example, be achieved by a separate adjusting device acting at some location or other on the loop in order to adjust its size.

In a particularly simple embodiment of the inventive strap clamping device, a first end of the loop is arranged at a fixed location on the clamping strap, and the clamping strap continues beyond a second end of the loop as clamping strap reserve. The size of the loop is variable by increasing or decreasing the clamping strap reserve, and the size of the loop is fixable by exact positioning of the first end relative to the second end.

This solution provides an operator in a simple and transparent way with the possibility of adjusting the size of the loop.

The first and second ends of the loop could, for example, be arranged at a separate fixing device which serves to adjust the size of the loop.

It is, however, particularly advantageous for the first end and the second end of the loop to engage the tightening device.

Herein it is preferable for a fixing device to be provided for fixing the second end in the tightening device.

It is, for example, possible to fix the first end in the tightening device independently of the fixing device.

However, in a particularly expedient solution the first end and the second end are fixable in the fixing device of the tightening device so the pulling force at one end of the loop acts directly on the other end of the loop.

To enable fixing of the clamping strap in an optional position in the fixing device, it is preferable for the fixing device to act on the clamping strap to secure it by force.

In this case, it is particularly advantageous for both the first end and the second end of the loop to be fixable in the fixing device as the fixing device then acts on both ends, and, for example, presses both ends against each other, which, in particular, in the case of a braided or textile clamping strap, on account of the high surface friction, results in direct fixing of the two ends relative to each other owing to the friction between each other in the fixing device.

The fixing device can vary widely in design. In an advantageous embodiment of the fixing device, it comprises a fixing element and an abutment between which the clamping strap is clampable.

To clamp the clamping strap between the fixing element and the abutment, in principle, a separate actuating device, for example, with a toggle mechanism can be provided.

In a solution which is particularly easy to handle, the fixing device and the adjusting device are simultaneously actuatable, in particular by means of the same actuating element, and so in addition to the easy handling, it is also ensured that upon actuation of the adjusting device to clamp the clamping strap, the fixing device is also actuatable to fix at least one end of the loop.

A solution in which the actuation of the fixing device occurs automatically when the adjusting device is actuated to clamp the clamping strap is particularly reliable in its handling.

In a particularly advantageous embodiment of the inventive solution, however, the fixing element is actuatable by the adjusting device when the base element and the pull element move relative to each other.

In the simplest case, the adjusting device is supported via the fixing device on the base element, and the fixing device thus fixes at least the second end of the loop and possibly also the first end relative to the base element.

In this case it is particularly advantageous for the end of the loop fixed by the fixing device to represent the one location at which the loop rests on the base element in engagement therewith.

In the above description of the individual embodiments, the effect of the pull element on the loop was not explained in greater detail. In an advantageous embodiment, the pull element comprises two pull members, each of which acts on the loop at one of the at least two further locations.

The pull members are preferably arranged on either side of the adjusting device on the pull element.

No details of the adjusting device were given in the above description of the individual embodiments. Any kind of actuating means which generates a relative movement between base element and pull element is conceivable as adjusting device.

An adjusting device which is particularly advantageous in view of its simplicity of design and ease of operation, and with which high forces can also be generated, comprises a spindle and a spindle nut running on the spindle.

Such a spindle has the advantage that while being easy to operate, it is able to generate a high force over relatively large paths, which, in particular, in the present case in which the relative movement between pull element and base element has the effect of a double pulley on the outer loop, is important.

Such an adjusting device can act in many different ways on the base element and the pull element. In an embodiment which is particularly advantageous and simple from a structural viewpoint, the spindle nut is held on the pull element, and the spindle is supported on the base element.

In the simplest case, the spindle is supported with a spindle end on the fixing element of the fixing device.

To guide the pull element carrying the spindle nut in a rotationally fixed manner relative to the adjusting spindle, provision is preferably made for the pull element to be guided so as to be non-rotatable, but moveable on a linear guide connected to the base element in the direction towards and away from the latter.

This linear guide can vary greatly in design. In an advantageous construction of the linear guide, it is formed by part of a housing, preferably by walls of the latter, on which, in particular, also the base element is held.

In the simplest case, the base element forms part, preferably a bottom part, of the housing.

In the description of the base element design, the construction of the guide openings for the loop was not explained in greater detail. It is, for example, conceivable to provide a single opening in the base element through which the loop is guided to the pull element. It is, however, particularly advantageous for the base element to have two guide openings, each of which is for one respective strand of the loop.

The guide openings are preferably located such that the respective strand of the loop following on the respectively formed loop section between base element and pull element extends through the respective guide opening.

The way in which the clamping strap reserve is to be arranged on or in the tightening device was not described in greater detail. In principle, it is possible to allow the clamping strap reserve to simply run out of the tightening device in a freely falling manner or to provide a cavity in which the clamping strap reserve is storable in an unordered way.

In a particularly advantageous embodiment, however, the tightening device has a carrier for the clamping strap reserve, on which, in particular, the clamping strap reserve can be deposited in an orderly manner.

This carrier is preferably in the form of a winding member for the clamping strap reserve, onto which the clamping strap reserve can thus be wound in an orderly fashion.

The winding member could be formed by the housing itself so the clamping strap reserve can simply be wound onto the winding member formed by the housing.

However, it is more advantageous for the winding member to form a spool which is rotatable relative to the housing and onto which the clamping strap reserve can be wound in the form of a coil.

The spool is preferably rotatable with a crank handle to wind up the clamping strap reserve.

In the above description of the individual embodiments, the way in which the outer loop of the clamping strap acts on the workpieces was not explained in greater detail.

In an advantageous solution, the outer loop is provided with corner elements for acting on the workpieces.

For example, during the placing of the outer loop around the workpieces, these corner elements could be freely insertable between the clamping strap and the respective workpieces. However, this has the disadvantage that simple operation of the inventive strap clamping device is no longer possible.

For this reason, provision is preferably made for the corner elements to be captively fixable on the clamping strap.

To fix them on the clamping strap, the corner elements are preferably provided with holding elements which engage the clamping strap. These can vary greatly in design.

In a particularly advantageous embodiment, the holding elements are designed such that the clamping strap is pushable transversely to its longitudinal direction into a position fixed by the holding elements at the corner elements so there is no necessity to open the outer loop and, for example, guide the clamping strap through an opening surrounding it on all sides.

The holding elements are preferably designed so as to engage over the clamping strap from a side edge on a flat side.

To additionally secure the clamping strap against sliding out of the respective holding element, it is expedient to also provide a securing element which secures the clamping strap against sliding out of the holding element. In the simplest case, this securing element can be a projection on which the clamping strap rests with the side edge over which the holding element does not extend.

It is particularly expedient for the securing element to likewise constitute a holding element and for the two holding elements to thus extend over the clamping strap from opposite side edges of the clamping strap.

The corner elements can vary greatly in design.

To ensure that these can engage over workpiece corners having very different angles, provision is preferably made for the corner elements to surround a cavity in U-shaped configuration and to have at the ends of the legs of the U pressure noses with which the corner elements act on the workpieces. For example, the corner elements can be placed on workpiece corners such that the pressure noses rest on opposite sides of the corners.

The corner elements can be designed so as to act with their pressure noses directly on the workpiece. However, it is even more advantageous for the corner elements to be provided in the region of their pressure noses with pressure parts which are pivotably mounted on the pressure noses and, for their part, have pressure surfaces with which the pressure parts act on the workpiece.

The pressure parts are provided with, for example, plane or slightly curved pressure surfaces.

The corner elements are preferably designed such that the clamping strap rests fully on these in the direction transverse to its longitudinal direction in order to achieve as good a pressing effect as possible.

In addition, the corner elements are preferably designed such that the pressure noses are arranged symmetrically in relation to a center line of the clamping strap.

It is also preferable for the pressure parts to be designed so as to extend symmetrically in relation to a center plane of the clamping strap.

In a particularly advantageous embodiment of the inventive strap clamping device, to clamp workpieces of symmetrical and irregular shape with a textile strap and several clamping corners to be inserted to protect the workpieces and to improve sliding of the clamping strap along these during clamping by means of a conventional clamping element, the strap clamping device is constructed within a tightening apparatus or a tightening device, with the clamping strap being guided within the tightening apparatus or the tightening device in clamping channels of deflection corners—also referred to as pull members—so a double pulley effect is obtained and when clamping is carried out, preferably with a spindle, the two clamping strap sides are firmly clamped between a pressure plate attached to the end and the surrounding housing.

In this solution, it is even more advantageous for the tightening apparatus or tightening device to consist of the strap guide, the housing of the tightening device, the clamping element and the clamping strap, with the housing surrounding the strap guide so as to provide exact guidance for and prevent deflection of the strap.

In a further advantageous variant of the inventive solution, there are provided in the housing on the side facing the workpiece two openings through which the strap passes and by means of which the strap is pulled inwards on a radius during the clamping.

In a further favorable variant, the strap guide has strap guide channels with a depth corresponding to the strap width, and to facilitate assembly, when necessary, markings are permanently made in the part on the open side which is preferably a plastic injection molded part.

In the inventive solution, it is also expedient for the strap to be guided in the strap guide in such a way that the end which is inserted at the fixed point and the opposite side which is pulled in and out can be clamped between the pressure plate and the upper side of the housing. The stronger the clamping via the spindle, the better the clamping straps hold.

As an alternative to this, it is advantageous for the pressure plate to have a depression to completely relieve the clamping straps by the turning back and make it easier for them to be pulled through.

In a further expedient solution within the scope of the invention, a marking indicating the pulling-in and pulling-out direction is made on the outside of the housing.

Cams for winding up the strap during storage of the clamping apparatus and a slot for securing the strap are preferably provided on the housing.

In a further expedient solution according to the invention, the clamping apparatus or the tightening device is additionally equipped with two or more corner elements or clamping corners for protecting the workpiece edges and for improving the sliding of the clamping strap around these edges. These corner elements are infinitely useable for edges or miter angles of from 45° to 120° and are captively mountable, if required, subsequently, on the clamping strap.

The clamping corner or the corner element is preferably made of one part in the shape of an open cylinder, with the opening being located such that acute angles and obtuse angles have room within the inner cavity of the hollow cylinder.

It is also expedient for the strap to be guided in a slot which is upwardly open, with a projection in the downward direction and an insertion incline in the upward direction, and a cam formed on each of the two sides.

This cam is expediently formed on the cylinder and has an insertion incline with a projection functioning as barb to secure the strap. The projection is located lower than the end of the slot.

It is also expedient for parts provided with clamping surfaces to be clipped onto a cylindrical section of the clamping corners which has a diameter so that they will lie better on the workpiece.

An advantageous embodiment of an inventive strap clamping device offers the possibility of quickly achieving a high clamping force with maximum operating comfort after the strap has been placed around the workpiece.

The strap clamping device is constructed as a compact apparatus with strap inlet and outlet.

For actuation, this strap clamping device should be provided with a generally known clamping element.

The strap clamping device is also preferably equipped with protective or clamping corners for the most common miter angles.

During the clamping, the clamping strap is to be pulled in evenly on both sides. The clamping corners should be useable infinitely for miter angles or clamped corners of 45° to 120°, fit the manufactured angle and rest in a slightly resilient manner thereon. Where required, they should be able to be placed on the strap without having to wind it up or unwind it and so enable rapid changeover to clamping with or without clamping corners. They should also hold on the clamping strap such that they cannot be lost. For storage purposes, it is advantageous to be able to wind up the clamping strap and attach the protective corners to the tightening device in such a way that they cannot be lost.

Further features and advantages are set forth in the following description and the appended drawings of several embodiments.

BRIEF DESCRIPTION OF THE DRAWINGS

FIG. 9 a plan view of a second embodiment of an inventive strap clamping device;

FIG. 10 a section along line 10—10 in FIG. 9;

FIG. 14 a side view of a second embodiment of a corner element;

FIG. 15 a plan view of the corner element in the direction of arrow C in FIG. 14;

FIG. 16 a side view of a second embodiment of the corner element in FIG. 14 with pressure parts; and FIG. 17 a view of an assembled pressure part in the direction of arrow D in FIG. 16.

DETAILED DESCRIPTION OF THE INVENTION

Figure 1:
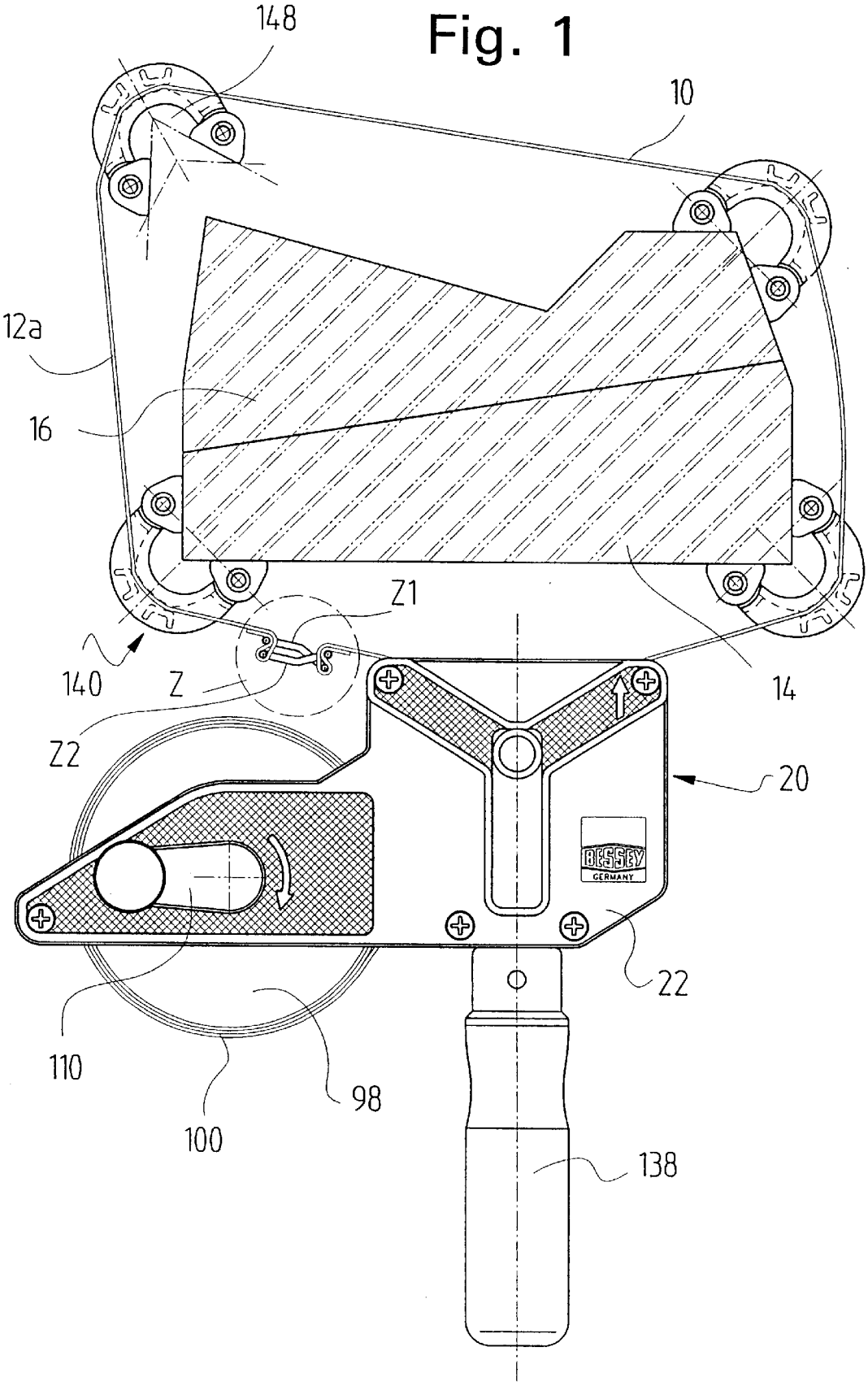
FIG. 1 a general view of a first embodiment of an inventive strap clamping device.

A strap clamping device, illustrated as a whole in FIG. 1, comprises an outer loop 12*a* which is formed by a clamping strap 10, preferably a textile strap. The loop 12*a* winds around the outside of, for example, two workpieces 14 and 16 and leads to a tightening device, designated as a whole 20, which serves to tighten the outer loop 12*a*.

Figure 2:
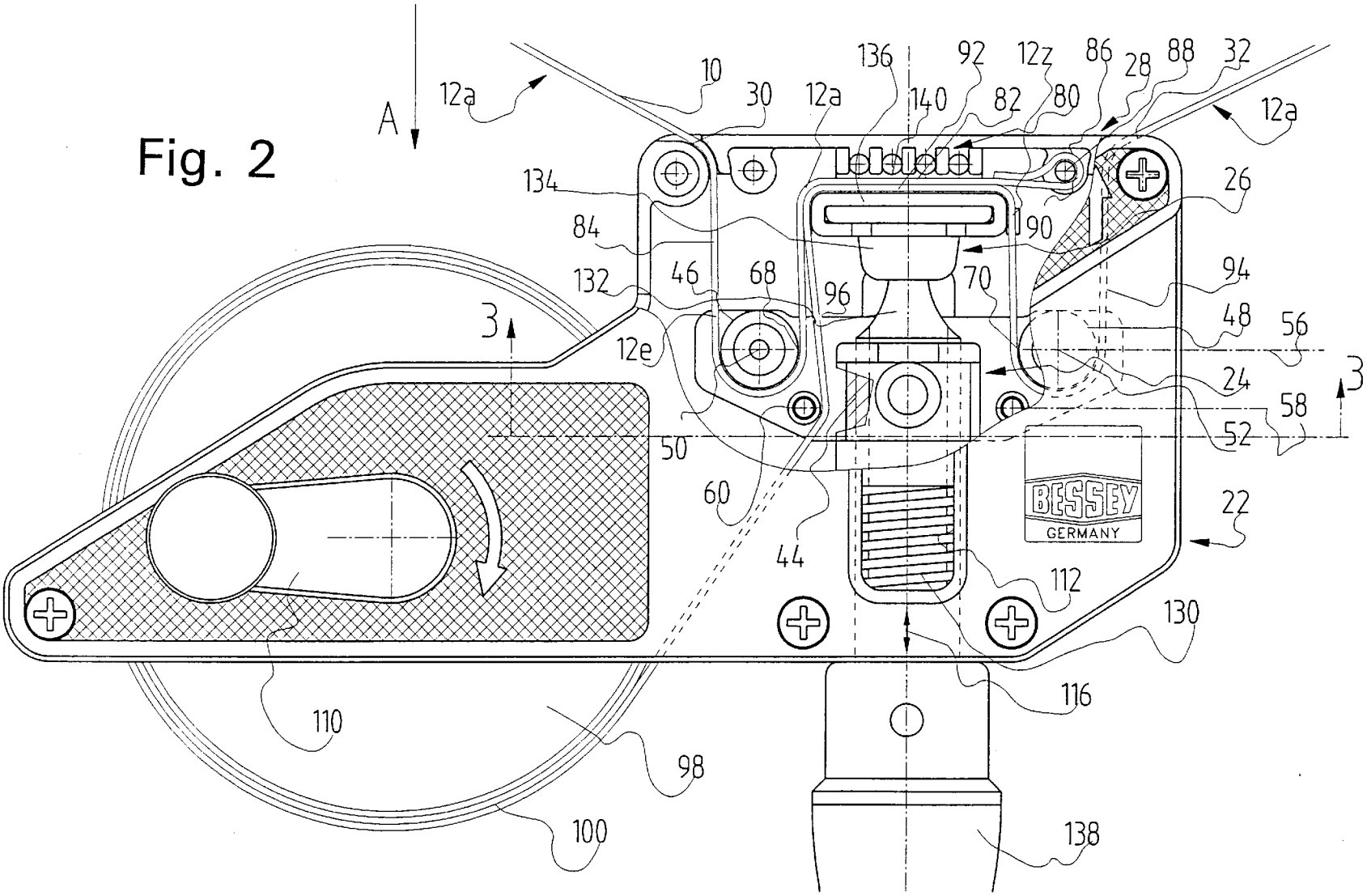
FIG. 2 an illustration of a tightening device of the first embodiment of the inventive strap clamping device with the housing partly broken open.

The tightening device 20 comprises a housing 22 in which a pull element 24 is arranged, as illustrated in FIG. 2. The pull element 24 is displaceable by means of an adjusting device, designated as a whole 26, relative to a base element, designated 28, which forms a base side of the housing 22 and has two guide openings 30 and 32 through which the clamping strap 10 is guided from the outer loop 12*a* into an interior of the housing 22.

Figure 3:
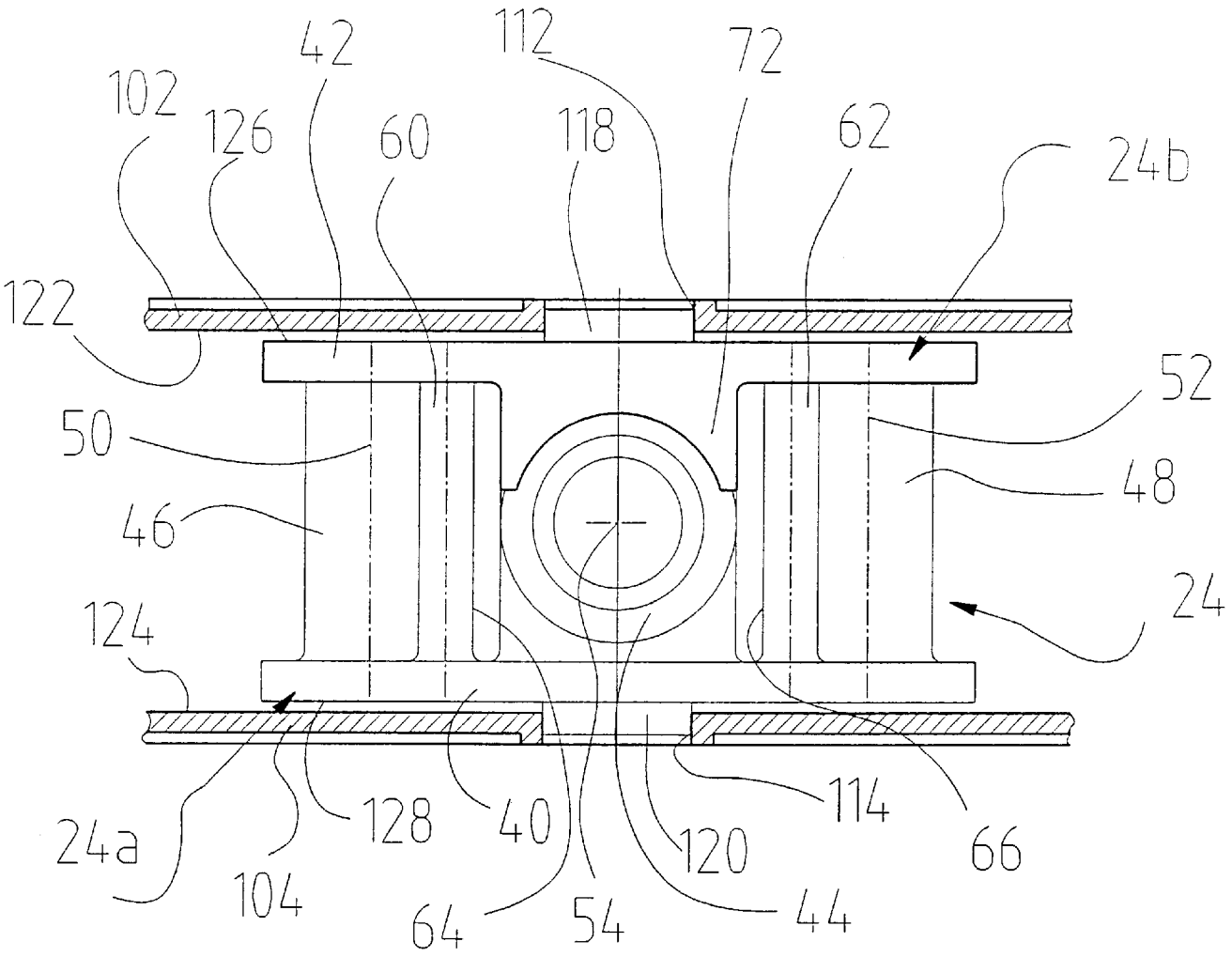
FIG. 3 a section through a partial region of the tightening device along line 3—3 in FIG. 2.

The outer loop 12*a* is provided with a lock Z with lock elements $Z_1$ and $Z_2$ which are connectable to and releasable from each other. The lock Z makes it possible to open the outer loop 12*a* to enable it to be placed around the workpieces 14 and 16 without these having to be pushed through the loop from a position alongside it. When a particularly large outer loop 12*a* is required, the lock Z also offers the possibility of opening the lock Z and inserting between the lock parts $Z_1$ and $Z_2$ an extension piece which has at both of its ends lock parts which are connectable to the lock part $Z_1$ and $Z_2$, respectively, As illustrated in FIGS. 2 and 3, the pull element 24 comprises two side cheeks 40 and 42 which extend parallel to one another and between which a spindle nut 44 is arranged. Also extending between these side cheeks 40 and 42 on either side of the spindle nut 44 and preferably lying symmetrically in relation to the spindle nut 44 are pull rolls 46 and 48. These are each mounted rotatably on the side cheeks 42 and 44, with their axes of rotation 50 and 52 preferably extending parallel and in a plane 56 lying perpendicular to an axis 54 of the spindle nut 44.

In addition, guide rolls 60 and 62 are provided on a side of the plane 56 facing away from the base element 28. The guide rolls 60 and 62 lie in a plane 58 lying parallel to the plane 56 and also extend between the side cheeks 40 and 42. The guide rolls 60 and 62 lie opposite the pull rolls 46 and 48 in offset relation to the spindle nut 44, more particularly, to the extent that the spacing of their circumferential surface 64, 66 facing the spindle nut 44 from the spindle nut 44 is less than that of the circumferential surface 68, 70 of the pull rolls 46, 48 facing the spindle nut 44.

The entire pull element 24 is preferably comprised of two parts 24*a* and 24*b*. Part 24*a* comprises the side cheek 40 and a bearing for the pull rolls 46 and 48 as well as the guide rolls 60 and 62 which are integrally formed thereon. The spindle nut 44 is also integrally formed on the cheek 40.

The second part 24*b* preferably comprises the side cheek 42 as well as receiving means for the bearings of the pull rolls 46 and 48 and the guide rolls 60 and 62 and a supporting element 72 which rests against the spindle nut 44 and additionally stabilizes it. The two parts 24*a* and 24*b* are joined to one another by conventional securing elements.

As further illustrated in FIG. 2, the loop 12 proceeds from a first end 82 fixable in a fixing device 80 and following on the first end forms with a first loop strand 12*e* a U-shaped loop section 84 proceeding from the fixing device 80 and winding around the pull roll 46. Following thereon, the strand 12*e* then passes through the guide opening 30 in the form of a curved slot extending through the base element 28 out of the housing 22 to then form the outer loop 12*a* lying outside the tightening device 20.

The clamping strap 10 also extends beyond the first end 82 of the loop 12 and forms an end piece 86 which is fixed on the base element 28 by means of a holding pin 88 which passes through an eyelet 90 formed by the end piece 86.

From a second end 92, which is also fixable in the fixing device 80, there extends a second strand 12*z* of the loop 12 also in the form of a U-shaped loop section 94 over the pull roll 48 to then also run through the guide opening 32 in the form of a curved slot in the base element 28 and pass out of the housing 22 so as to form the outer loop 12*a* lying outside the tightening device 20.

Following on the second end 92 of the loop 12, the clamping strap 10 extends beyond the fixing device 80 and forms a clamping strap reserve 96 which is guided over the circumferential surface 64 of the guide roll of the pull element 24 facing the spindle nut 44 and following on the guide roll 60 can be wound up in the form of a coil 100 on a spool 98.

Figure 4:
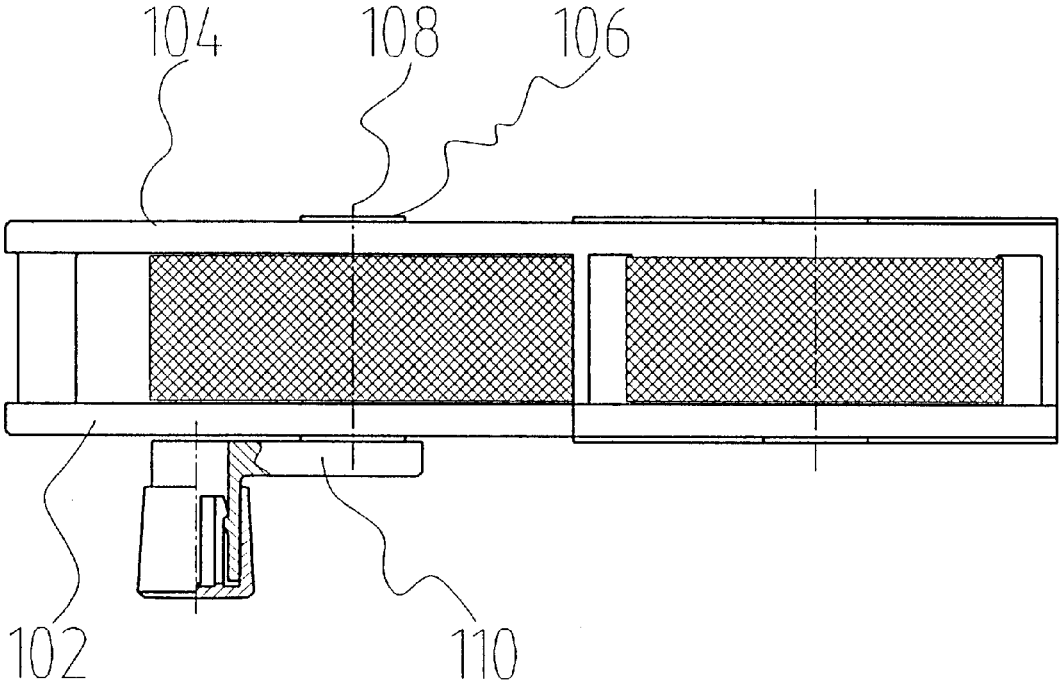
FIG. 4 a plan view of the tightening device in the direction of arrow A in FIG. 2.

As illustrated in FIG. 4, the spool 98 is arranged between two side walls 102 and 104 of the housing 22 and mounted for rotation about an axis 108 by means of a shaft 106 extending through the side walls 102 and 104. On one side, a crank handle 110 is connected to the shaft 106 in a rotationally fixed manner. The clamping strap reserve 96 can be wound in the form of the coil 100 onto the spool 98 with the crank handle 110. As further illustrated in FIGS. 2 and 3, the side walls 102 and 104 are also provided with longitudinal slots 112 and 114 in which the pull element 24 is guided for movement in a direction of adjustment 116 relative to the base element 28. The pull element 24 engages the longitudinal slots 112 and 114 with projections 118 and 120. The pull element 24 also rests with outer sides 126 and 128 against inner sides 122 and 124 of the side walls 102 and 104 and is thereby additionally guided so as to be non-rotatable but displaceable in the direction of adjustment 116.

The longitudinal slots 112 and 114 extend parallel to the direction of adjustment 116.

The adjusting device 26 provided for moving the pull element 24 relative to the base element 28 comprises a spindle 130 which extends through the spindle nut 44 and engages with its spindle end 132 in a pressure member 134 which is additionally provided with a fixing shoe 136.

The spindle 130 with the pressure member 134 arranged at its spindle end 132 is preferably equipped as a customary clamping spindle in clamps with a conventional pressure member 134, and the spindle 130 is rotatable by a spindle grip 138 which is also customary in clamps.

The fixing shoe positioned on the pressure member 134 forms together with an abutment 140 arranged on the base element 28 the fixing device 80 in which the first end 82 and the second end 92 of the loop 12 are fixable. The fixing is brought about by the two ends 82 and 92 of the loop 12 being clamped between the abutment 140 and the fixing shoe 136 when the spindle 130 is rotated by turning the spindle grip 138 so that the pull element 24 moves away from the base element 28 and the pull rolls 46 and 48 acting on the loop sections 84 and 94 to increase these thus causes the clamping strap of the outer loop 12*a* to be drawn via both the first strand 12*e* and the second strand 12*z* through the guide openings 30 and 32 into the housing 22 and the outer loop 12*a* to thereby be reduced in size. To apply the force with which the pull rolls 46 and 48 act on the loop sections 84 and 94 to increase these, the spindle 130 must be finally supported on the base element 28 via the pressure member 134 and the fixing shoe 136. This occurs via the ends 82 and 92 of the loop 12 clamped between the fixing shoe 136 and the abutment 140 and so the supporting of the spindle 130 on the base element actually occurs via the fixing device 80 and thereby simultaneously fixes the ends 82 and 92 of the loop relative to the base element 28.

Owing to the increase in the two loop sections 84 and 94, the path through which the pull element 24 travels during its movement away from the base element 28 affects the outer loop 12*a* lying outside the tightening device 20 in four ways to shorten the loop 12*a*.

To clamp the workpieces 14 and 16, the outer loop 12*a* lying outside the tightening device 20 is first placed either with or without corner elements 140, which will be explained hereinbelow, around the workpieces 14 and 16 and by winding up the clamping strap reserve 96 on the spool 98, with the adjusting device 26 released, the outer loop 12*a* is tightened to such an extent that it encircles the workpieces 14, 16 either directly or via the corner elements and rests against these.

In this released position of the adjusting device 26, the pull element 24 lies in its closest position to the base element, and, therefore, the fixing shoe 136 is also not supported on the abutment 140, and so the clamping strap 10 continuing via the second strand 12*z* in the form of the clamping strap reserve 96 can be pulled through the fixing device 80, and with the outer loop 12*a* resting against the workpieces 14 and 16, the second end 92 then lies in the fixing device 80.

When the spindle grip 180 is turned so that the pull element 24 moves away from the base element 28 owing to the action of the spindle 130, the spindle end 132 is automatically supported via the pressure member 134 and the fixing shoe 136 on the abutment 140, and so the fixing device 80 formed by the fixing shoe 136 and the abutment 140 fixes the ends 82 and 92 of the loops by clamping with force, and the increase in size of the loops 84 and 94 caused by the movement of the pull element 24 brings about a reduction in the size of the outer loop 12*a* lying outside the tightening device 20, and the workpieces 14 and 16 are thereby clamped together.

To act upon the workpieces 14, 16 at a specific point, preferably in the region of their corners, with a clamping force originating from the outer loop 12*a*, corner elements 140 are preferably employable within the scope of the inventive strap clamping device.

Figure 5:
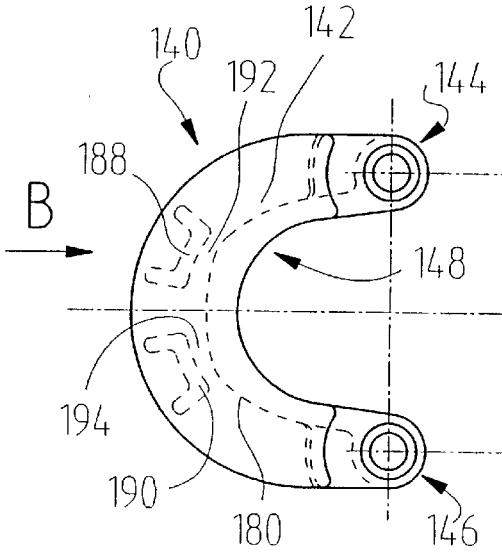
FIG. 5 a side view of a corner element without pressure parts.
Figure 6:
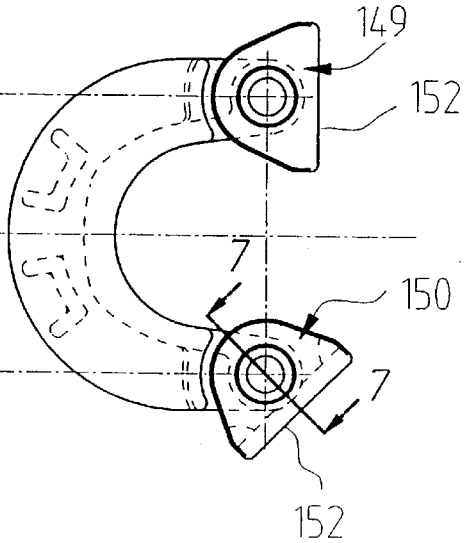
FIG. 6 a side view of the corner element with pressure parts.

As illustrated in FIGS. 5 and 6, each of these corner elements 140 has a main body 142 forming two pressure noses 144 and 146, with a cavity 148 lying between these. The main body 142 extending as far as the pressure noses 144 and 146 surrounds the cavity 148 in U-shaped cross section.

The cavity 148 serves to receive a corner of one of the workpieces 14 or 16, with the main body 142 being supported on either side of the corner on the workpiece.

The main body 142 can be supported directly with the pressure noses 144 and 146 insofar as this does not cause any surface damage to the workpieces 14 or 16.

Figure 7:
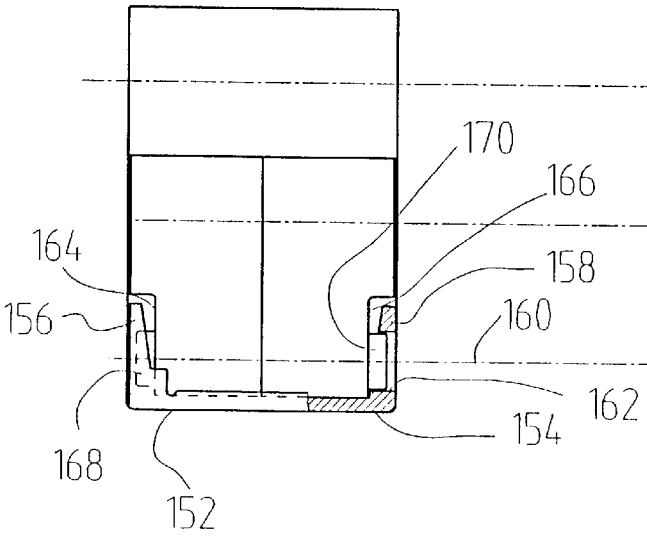
FIG. 7 a section along line 7—7 in FIG. 6.

It is particularly advantageous for the pressure noses 144 and 146 to also be provided with pressure parts 149, 150 which, as illustrated in FIGS. 6 and 7, have plane pressure surfaces 152 with which the pressure parts 149 and 150 can be placed on the surface of the respective workpiece 14, 16. The pressure surfaces 152 form the surface of a pressure plate 154, from the opposite narrow sides of which bearing plates 156 and 158 protrude on a side of the pressure plate 154 opposite the pressure surface 152. With the bearing plates 156 and 158 the pressure parts 149, 150 are mounted on the pressure noses 144 or 146 so as to be pivotable about an axis 160.

The bearing plates 156 and 158 preferably have bores 162 in which a cylindrical projection 168 and 170 arranged on opposite outer sides 164 and 166, respectively, of the pressure noses engages and thereby forms a pivot bearing for the pressure parts 149, 150.

The main body 142 extends in the direction of the pivot axis 160 and hence also in the longitudinal direction of the pressure surface 152 to an extent that ensures that the clamping strap 10 rests thereon securely with its entire width transversely to its longitudinal direction.

Figure 8:
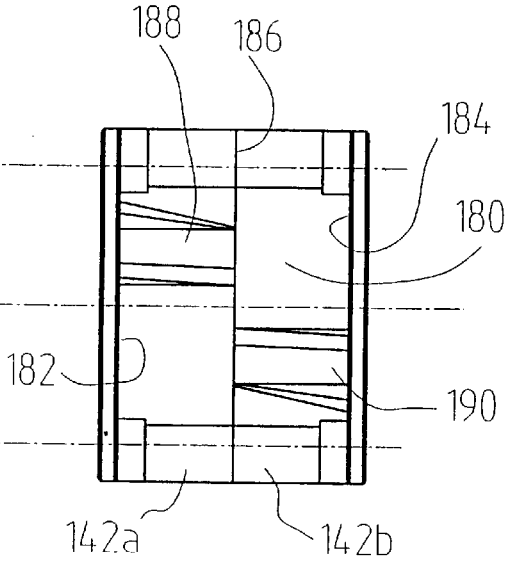
FIG. 8 a plan view of the corner element in the direction of arrow B in FIG. 5.

For this purpose, the main body 142, as illustrated in FIGS. 5 and 8, forms on its side opposite the cavity 148 a preferably arched supporting surface 180 for the clamping strap 10. On either side of the supporting surface 180 there are formed by the main body 142 side webs 182 and 184 which rise above the supporting surface 180 and between which the clamping strap 10 is guided so as to rest on the supporting surface 180. The side webs 182 and 184 prevent the clamping strap from sliding away at the side over the supporting surface 180.

Furthermore, projections 188 and 190 extend from each of the side webs 182 and 184 approximately as far as a center line 186 of the supporting surface 180, which also represents a center line of the clamping strap 10 lying on the latter, and are spaced from one another in the longitudinal direction of the clamping strap 10. The projections 188 and 190 extend over the supporting surface 180 at a spacing therefrom and leave a space 192 and 194 free between them and the supporting surface 180 so that the clamping strap 10 can be pulled through this space. In this way, the clamping strap 10 is not only fixable on either side of the supporting surface 180 by the side webs 182 and 184 but also on the main body 142 opposite the supporting surface 180 by the projections 188 and 190 in such a way that the clamping strap 10 cannot slide of its own accord over the main body 142 and, so the main body 142 is also guided on the loose clamping strap in the longitudinal direction thereof as the projections 188 and 190 prevent complete detachment from the supporting surface 180.

Owing to the fact that the projections 188 and 190 each extend only as far as the center line 186 of the supporting surface 180, introduction of the clamping strap 10 into the spaces 192 and 194 is possible in a simple way, namely by the clamping strap being pushable in the direction of the side web 182 and 184 carrying the respective projection 188 and 190 into the space 192 and 194, respectively.

The main body 142 is preferably formed by two halves 142*a* and 142*b* of identical design which lie against one another in a plane extending along the center line 186 and are fixed relative to one another.

In a second embodiment, illustrated in FIGS. 9 to 15, the tightening device designated 210 in FIG. 9 comprises a strap guide 212 which represents the pull element, a housing 214, a clamping spindle 216 with a pressure plate 218 and a spindle grip 220.

The clamping strap 222 is illustrated, for example, with its outer loop, lying freely around two workpieces 224 and 226.

When the clamping strap is pulled in the direction of arrow 223, in the simplest case the clamping strap places itself directly on the workpieces 224 and 226. At the spindle grip 220, the pressure plate 218 is brought via the spindle 216 out of its zero position in a depression 213 and positions itself at the upper part 215 of the housing 214. This upper part 215 forms the base element.

The pressure plate 218 thereby clamps between itself and the upper part of the housing 214 the strap sides 225 and 227—also referred to as ends of the loop of the clamping strap—and with the clamping procedure renders additional fixing of the strap sides 225 and 227 superfluous.

Fixing elements which would otherwise be necessary can thus be dispensed with.

The strap end 225 illustrated as the upper one in FIG. 9 is held firmly in a region 203 of the housing 214 and is guided outwards in the other direction around a deflection corner 230 through a housing opening 209 in the housing 214. The strap end 227 illustrated as the lower one is guided around a corner 233 towards an actuating side out of the housing 214.

In the other direction, it runs around a deflection corner 232 and after passing through a housing opening 207 forms the opposite side of the workpiece enclosure.

By means of a nut thread 217 in the strap guide 212, the pressure plate 218 pushes the housing 214 in the direction of the workpiece 26 and pulls the clamping strap twofold around the deflection corners 230 and 232 of the strap guide 212.

This results in a twofold pulley effect and doubles on both sides the stroke of the spindle 216 during the clamping procedure. If the stroke of the spindle 216 is h, the total path of the strap is then $s=2\times2h$, i.e., $s=4h$.

The housing 214 encloses the strap guide 212—also referred to as pull element—tightly and with inner side surfaces 234 and 235 provides exact guidance for the strap guide 212 during the clamping procedure.

To prevent the strap guide 212 from falling out completely, detent cams of generally known design can be provided on one of the two parts 212 and 214 which are preferably made of plastic.

The strap guide 212—also referred to as pull element—preferably has arrow markings 236 which facilitate insertion of the clamping strap, as illustrated in FIG. 9.

Projections, preferably constituted by cams 237 and 238, are provided on the housing 214. The clamping strap 222 can be wound up between these when the clamping device is stored. One end of the clamping strap can be secured against automatic winding-up in a slot 239.

A plan view of a tightening device 210 without the workpieces 224 and 226 is illustrated in FIG. 10. The clamping strap 222 leading out of the tightening device is shown cut off on both sides thereof.

The clamping strap 222 which is preferably of reinforced, broad design is guided exactly between a longitudinal side 240 of the housing 214 and the strap guide 212, i.e., the pull element. Neither turning nor deflection is possible.

Strap channels provided for the clamping strap 222 in the strap guide 212 have a depth as far as a stable bottom part 241 of the strap guide 212 which corresponds to the strap width with some additional play. A strap center or an actuating axis 205 thereby gains an asymmetrical position which facilitates actuation by a hand resting on a support.

Figures 11, 12, 13:
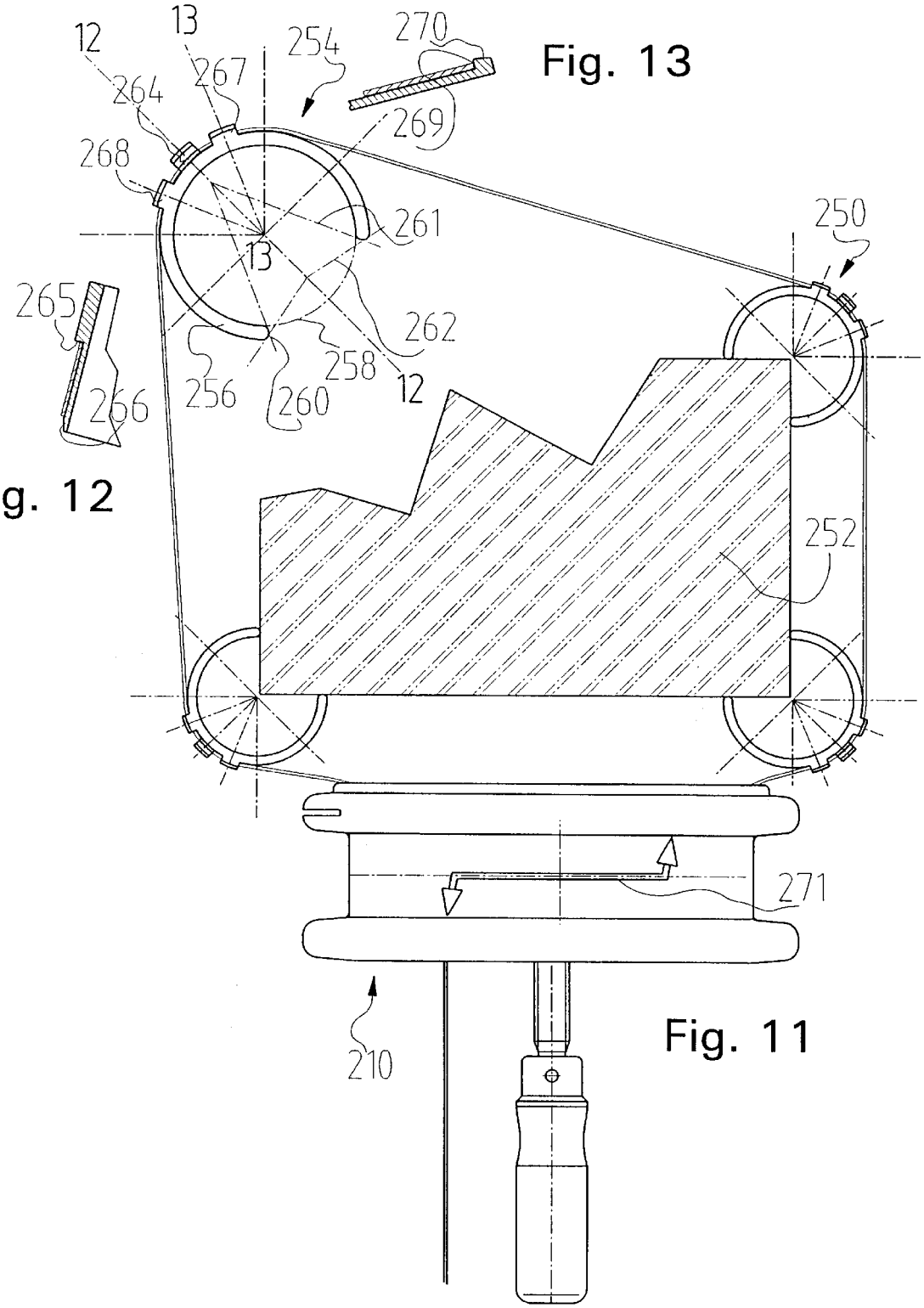
FIG. 11 an enlarged general view of the second embodiment of the inventive strap clamping device when clamping with corner elements or clamping corners.
FIG. 12 a section along line 12—12 in FIG. 11.
FIG. 13 a section along line 13—13 in FIG. 11.

The tightening device 210 is illustrated in FIG. 12 together with four corner elements or clamping corners 250 hung in position and a workpiece 252 placed in position. An enlarged illustration 254 of one of the four clamping corners 250 illustrates the structural design more clearly.

A main body 256 is in the form of a hollow body, preferably with inherent resilience, in this case, an open cylinder, which with an opening 258 resiliently embraces the corners and miter joints. It rests on the workpiece 252 with a rounded-off part 260 which is adapted to fit all angles.

In an interior of the main body 256 in the form of a hollow body, there is space for workpiece tips which are exposed for observation, as illustrated, for example, alternatively for acute angles 261 and obtuse angles 262 in the region of the workpiece tips in FIG. 3.

The likewise cylindrical outer shape of the clamping corner 254 allows the clamping strap 222 to slide along during clamping without any great frictional losses. It runs within a slot 264 on the projection 265 which can be seen in FIG. 12 in a section taken along line 12—12.

A insertion incline 266 is provided on the opposite side. Two projections 267 and 268 in the form of barbs prevent unintentional loss of the clamping corners 254.

A corresponding protrusion 269 and an insertion incline 270 are illustrated in FIG. 13 in a section taken along line 13—13.

In the illustrated embodiment, to make simple operation visible to a user, a double arrow 271 indicating clearly the direction for pulling in and out the clamping strap is provided on the housing 214.

The arrangement of the projections 267 and 268 and the protrusion 269 is illustrated again clearly in FIGS. 14 and 15, with the protrusion 269 of the projections 267 and 268 lying clearly below an end 272 of the slot so the clamping strap is secured from slipping out.

Clamping corners 250 with a rotatably arranged clamping surface 274 are illustrated in FIGS. 16 and 17. In an opening which ends at a height indicated by a point 275 and allows play at a depth indicated by a point 276, a part 277 is rotatably clipped onto a partial section of the main body 256 forming a cylinder surface with a diameter 278.

The clamping surface 274 has a curvature 280 right around. The axis of rotation 279 of the pressure plate 277 corresponds to the asymmetrically arranged axis 205 in FIG. 10.

A strap clamping device with a tightening device or a tightening apparatus 210, which is additionally provided with two or more clamping corners 250 so as to protect the workpiece edges and so that the clamping strap 222 can slide better around these edges, is particularly advantageous.

It is particularly expedient for the corner elements or clamping corners 250 to be infinitely useable for edge and miter angles of 45° to 120°.

It is expedient for these corner elements or clamping corners 250 to be mountable, where required, subsequently, on the clamping strap 222 such that they cannot be lost.

It is also particularly expedient for the clamping corner 250 to be manufactured as one part in the shape of an open cylinder, as illustrated in FIGS. 14 and 15. The opening 258, as illustrated in FIG. 11, is preferably arranged such that acute angles, designated by the reference numeral 261, or also obtuse angles, designated by the reference numeral 262, have room in the inner space or cavity of the hollow cylinder.

It is also particularly advantageous for the strap to be guided in a slot 264 which is upwardly open, in the downward direction has a protrusion 265 and in the upward direction an insertion incline 266, and a cam 267 and 268 formed on each of the two sides of the cylinder, with an insertion incline 270 and a projection 269 functioning as barb to secure the clamping strap. The projection 269 is located lower than the slot end 272.

In order that it will lie better on the workpiece 252, it is also expedient, as illustrated in FIGS. 16 and 17, for the respective clamping corner 250, also referred to as corner element, to be provided with parts 277, also referred to as pressure parts, which are provided with clamping surfaces 274 and are clipped onto a part of the clamping corner 256 forming a rounded part with a diameter 278.

Provision is also advantageously made for the center line 279 of the recess provided in the clamping corner 256 and formed by the delimitations 275 and 276 to correspond to the center line designated 205 in FIG. 10.

What is claimed is:

1. A strap clamping device, comprising:

a clamping strap forming a loop comprising an outer loop section to wrap around at least one workpiece;

a tightening device for tightening said outer loop section to clamp said at least one workpiece;

said tightening device comprising a base element supported on said loop with a guide by which said loop is guided;

said tightening device further comprising a pull element;

said pull element and said base element being moveable relative to each other by means of an adjusting device;

said loop running between said base element and said pull element and forming two pulley loop sections such that upon movement of said base element and said pull element relative to each other, said outer loop section is tightenable under the effect of a double pulley.

2. A strap clamping device as defined in claim 1, wherein:

said loop rests at a first location on said base element and at least at two other locations on said pull element in engagement therewith.

3. A strap clamping device as defined in claim 2, wherein:

said two pulley loop section rest at said two other locations on said pull element.

4. A strap clamping device as defined in claim 1, wherein:

the size of said loop is variable.

5. A strap clamping device as defined in claim 4, wherein:

a first end of said loop is arranged at a fixed location on said clamping strap;

said clamping strap continues beyond a second end of said loop as a clamping strap reserve; and the size of said loop is variable by increasing or decreasing said clamping strap reserve.

6. A strap clamping device as defined in claim 5, wherein:

said first end and second end of said loop engage said tightening device.

7. A strap clamping device as defined in claim 2, wherein:

said pull element comprises two pull members, each of which acts on said loop at one of said at least two other locations.

8. A strap clamping device as defined in claim 7, wherein:

said pull members are arranged on either side of said adjusting device on said pull element.

9. A strap clamping device as defined in claim 1, wherein:

said adjusting device comprises a spindle and a spindle nut running on said spindle.

10. A strap clamping device as defined in claim 9, wherein:

said spindle nut is held on said pull element and said spindle is supported on said base element.

11. A strap clamping device as defined in claim 10, wherein:

a first end of said loop is arranged at a fixed location on said clamping strap;

said clamping strap continues beyond a second end of said loop as a clamping strap reserve;

a fixing device is provided for fixing said second end on said tightening device;

said fixing device comprises a fixing element and an abutment between which said clamping strap is clampable; and said spindle is supported with a spindle end on said fixing element of said fixing device.

12. A strap clamping device as defined in claim 1, wherein:

said pull element is guided so as to be non-rotatable, but moveable on a linear guide connected to said base element in a direction toward or away from said base element.

13. A strap clamping device as defined in claim 12, wherein:

said linear guide is part of a housing of said tightening device.

14. A strap clamping device as defined in claim 1, wherein:

said base element is part of a housing.

15. A strap clamping device as defined in claim 1, wherein:

said base element has two guide openings, each of which is for one respective strand of said loop.

16. A strap clamping device as defined in claim 15, wherein:

said guide openings are located such that the respective strands of said loop which extend from respectively formed loop sections between said base element and said pull element extend further through the respective guide openings.

17. A strap clamping device as defined in claim 5, wherein:

said tightening device has a carrier for said clamping strap reserve.

18. A strap clamping device as defined in claim 17, wherein:

said carrier is designed as a winding member for said clamping strap reserve.

19. A strap clamping device as defined in claim 1, wherein:

said double pulley effect provides a tightening of said outer loop section by a distance which is four times a distance of said relative movement of said base element and pull element.

20. A strap clamping device, comprising:

a clamping strap forming a loop comprising an outer loop to wrap around at least one workpiece; and a tightening device for tightening said outer loop to clamp said at least one workpiece, wherein:

said outer loop is provided with corner elements for acting on said at least one workpiece;

said corner elements are fixable on said clamping strap such that said corner elements cannot be lost;

said corner elements are provided with holding elements which engage said clamping strap; and said holding elements are designed such that said clamping strap is pushable transversely to its longitudinal direction into a position fixed by said holding elements at said corner elements.

21. A strap clamping device as defined in claim 20, wherein:

said holding elements engage over at least a portion of a flat side of said clamping strap beginning from a side edge of said clamping strap.

22. A strap clamping device as defined in claim 20, wherein:

said clamping strap is secured against sliding out of the holding elements.

23. A strap clamping device as defined in claim 20 wherein:

said corner elements have legs which surround a cavity in a U-shaped configuration and at the ends of the legs have pressure noses with which said corner elements act on said at least one workpiece.

24. A strap clamping device as defined in claim 23, wherein:

said pressure noses rest on opposite sides of the corners of said at least one workpiece.

25. A strap clamping device as defined in claim 23, wherein:

said corner elements are provided in the region of their pressure noses with pressure parts which are pivotably mounted on said pressure noses and have pressure surfaces with which said pressure parts act on said at least one workpiece.

26. A strap clamping device as defined in claim 25, wherein:

said pressure parts are provided with one of (a) planar pressure surfaces and (b) slightly curved pressure surfaces.

27. A strap clamping device as defined in claim 20, wherein:

said corner elements are designed such that said clamping strap rests fully on said corner elements.

28. A strap clamping device, comprising;

a clamping strap forming a loop having a first end and a second end and comprising an outer loop section to wrap around at least one workpiece;

a size of said loop being variable;

a tightening device for tightening said outer loop section to clamp said at least one workpiece;

said tightening device comprising a base element supported on said loop with a guide by which said loop is guided;

said tightening device comprising a pull element;

said pull element and said base element being movable relative to each other by means of an adjusting device;

said loop running between said base element and said pull element;

a fixing device for releasably fixing said clamping strap at one of said ends of said loop to one of said base element and said pull element;

said fixing device having a fixing position in which said one end of said clamping strap is fixed, and a release position in which said one end of said clamping strap is released, and is adapted to enter into said fixing position upon actuation of said fixing device; and one actuating element for actuating said fixing device and said adjusting device to cause said fixing device to move from said release position thereof to said fixing position thereof, and to cause the relative movement of said pull element and said base element.

29. A strap clamping device as defined in claim 28, wherein:

said first end and said second end are fixable in said fixing device of said tightening device.

30. A strap clamping device as defined in claim 28, wherein:

said fixing device acts on said clamping strap to secure it by force.

31. A strap clamping device as defined in claim 28, wherein:

said fixing device comprises a fixing element and an abutment between which said clamping strap is clampable.

32. A strap clamping device as defined in claim 28, wherein:

said fixing element is actuatable by said adjusting device when said base element and said pull element move relative to each other.

33. A strap clamping device as defined in claim 32, wherein:

said adjusting device is supported via said fixing device on said base element when said clamping strap is fixed by said fixing device.

* * * * *